US009461400B2

(12) United States Patent
Kanda et al.

(10) Patent No.: US 9,461,400 B2
(45) Date of Patent: Oct. 4, 2016

(54) ELECTRIC WIRE COVER

(71) Applicant: Yazaki Corporation, Tokyo (JP)

(72) Inventors: Hidenori Kanda, Makinohara (JP); Takuya Hasegawa, Fujieda (JP); Nobuyuki Mukoujima, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/994,300

(22) Filed: Jan. 13, 2016

(65) Prior Publication Data

US 2016/0204543 A1 Jul. 14, 2016

(30) Foreign Application Priority Data

Jan. 14, 2015 (JP) ..... 2015-005243

(51) Int. Cl.
*H01R 13/58* (2006.01)

(52) U.S. Cl.
CPC ..... *H01R 13/5812* (2013.01)

(58) Field of Classification Search
CPC ..... H01R 13/5812; H01R 13/506; H01R 13/582; H01R 13/5829; H01R 13/501; H01R 13/5833; H01R 4/2433; H01R 13/516
See application file for complete search history.

(56) References Cited

U.S. PATENT DOCUMENTS 6,926,535 B2 * 8/2005 Tsuji ..... H01R 13/501 439/31
7,201,592 B2 * 4/2007 Hata ..... H02G 3/0691 439/206
7,422,470 B2 * 9/2008 Tsuji ..... H01R 13/506 439/470
9,088,099 B2 * 7/2015 Urashima ..... H01R 13/506
9,184,542 B2 * 11/2015 Torii ..... H01R 13/5829
9,287,652 B2 * 3/2016 Torii ..... H01R 13/506
2014/0206242 A1 7/2014 Torii et al.

FOREIGN PATENT DOCUMENTS

JP 2013-45610 A 3/2013

* cited by examiner

*Primary Examiner* — Xuong Chung Trans
(74) *Attorney, Agent, or Firm* — Sughrue Mion, PLLC

(57) ABSTRACT

An electric wire cover includes: a first electric wire cover including a wire arrangement space like a groove opened on one side, and attached to a wire lead-out end of a connector housing; and a second electric wire cover formed integrally with the first electric wire cover through a hinge portion, and covering the wire arrangement space. A guide groove is provided in one of the first and second electric wire covers, and extends in a direction perpendicular to a rotation axis of the hinge portion. A rotation restriction rib is provided in the other electric wire cover and extends in the direction perpendicular to the rotation axis. The rotation restriction rib slides in the guide groove during rotating operation by the hinge portion so as to restrict rocking of the electric wire covers relative to each other.

4 Claims, 7 Drawing Sheets

ELECTRIC WIRE COVER

CROSS-REFERENCE TO RELATED APPLICATION(S)

This application is based upon and claims the benefit of priority from prior Japanese patent application No. 2015-005243, filed on Jan. 14, 2015, the entire contents of which are incorporated herein by reference.

BACKGROUND

1. Technical Field

The present invention relates to an electric wire cover to be attached to a wire lead-out end of a connector housing.

2. Background Art

FIG. 6 and FIG. 7 show an electric wire cover disclosed in JP-A-2013-45610.

This electric wire cover 100 is made of resin, and attached to a wire lead-out end 201 of a connector housing 200 as shown in FIG. 6, so as to restrict the lead-out direction of an electric wire 300 led out from the wire lead-out end 201.

The electric wire cover 100 has a first electric wire cover 110 to be attached to the wire lead-out end 201 of the connector housing 200, and a second electric wire cover 130 formed integrally with the first electric wire cover 110 through a hinge portion 120.

The first electric wire cover 110 has a wire arrangement space 111 like a groove opened on its one side (upper side), and a housing engagement portion 112 engaged with a cover engagement portion 202 provided on the external surface of the connector housing 200, so as to achieve connection with the connector housing 200.

A wire restriction wall 113 abuts against one side of the electric wire 300 arranged in the wire arrangement space 111, so as to position the electric wire 300 in the wire arrangement space 111.

The hinge portion 120 has a thin plate-like shape with flexibility. The hinge portion 120 is provided on one side of the first electric wire cover 110 so as to connect the second electric wire cover 130 to the first electric wire cover 110 rotatably.

The second electric wire cover 130 covers the wire arrangement space 111 of the first electric wire cover 110 openably/closably in accordance with rotation by the hinge portion 120.

However, in the electric wire cover 100 disclosed in JP-A-2013-45610, it is difficult to perfectly prevent twisting of the hinge portion 120 having a thin structure.

During operation for closing the first electric wire cover 110 with the second electric wire cover 130 put thereon, misalignment may occur between the paired electric wire covers due to the twisting of the hinge portion 120. Thus, there is a fear that the electric wire covers cannot be closed with each other.

SUMMARY

The present invention may provide an electric wire cover in which, when a pair of electric wire covers are closed, misalignment between the paired electric wire covers caused by twisting of a hinge portion is prevented so that the paired wire can be closed smoothly.

The electric wire cover may comprise: a first electric wire cover which includes a wire arrangement space like a groove opened on one side, and which is adapted to be attached to a wire lead-out end of a connector housing; and a second electric wire cover which is formed integrally with the first electric wire cover through a hinge portion, and which is configured to cover an open portion of the wire arrangement space openably/closably, wherein a guide groove may be provided in one of the first and second electric wire covers, and extend in a direction perpendicular to a rotation axis of the hinge portion, and a rotation restriction rib may be provided in the other of the first and second electric wire covers and extend in the direction perpendicular to the rotation axis of the hinge portion, and the rotation restriction rib may be configured to slide in the guide groove during rotating operation by the hinge portion so as to restrict rocking of the first and second electric wire covers relative to each other.

The guide groove and the rotation restriction rib may be provided in positions close to the hinge portion.

The first electric wire cover may include a wire restriction wall which is configured to abut against a side surface of an electric wire inserted into the wire arrangement space, so as to position the electric wire, and the rotation restriction rib may be formed integrally with the wire restriction wall and formed into a wall-like shape perpendicular to the wire restriction wall.

The wire restriction wall may be integrally formed into an L-shape to position the electric wire in an L-shape.

DETAILED DESCRIPTION OF EXEMPLARY EMBODIMENTS

A preferred embodiment of an electric wire cover according to the invention will be described below in detail with reference to the drawings.

Figure 1:
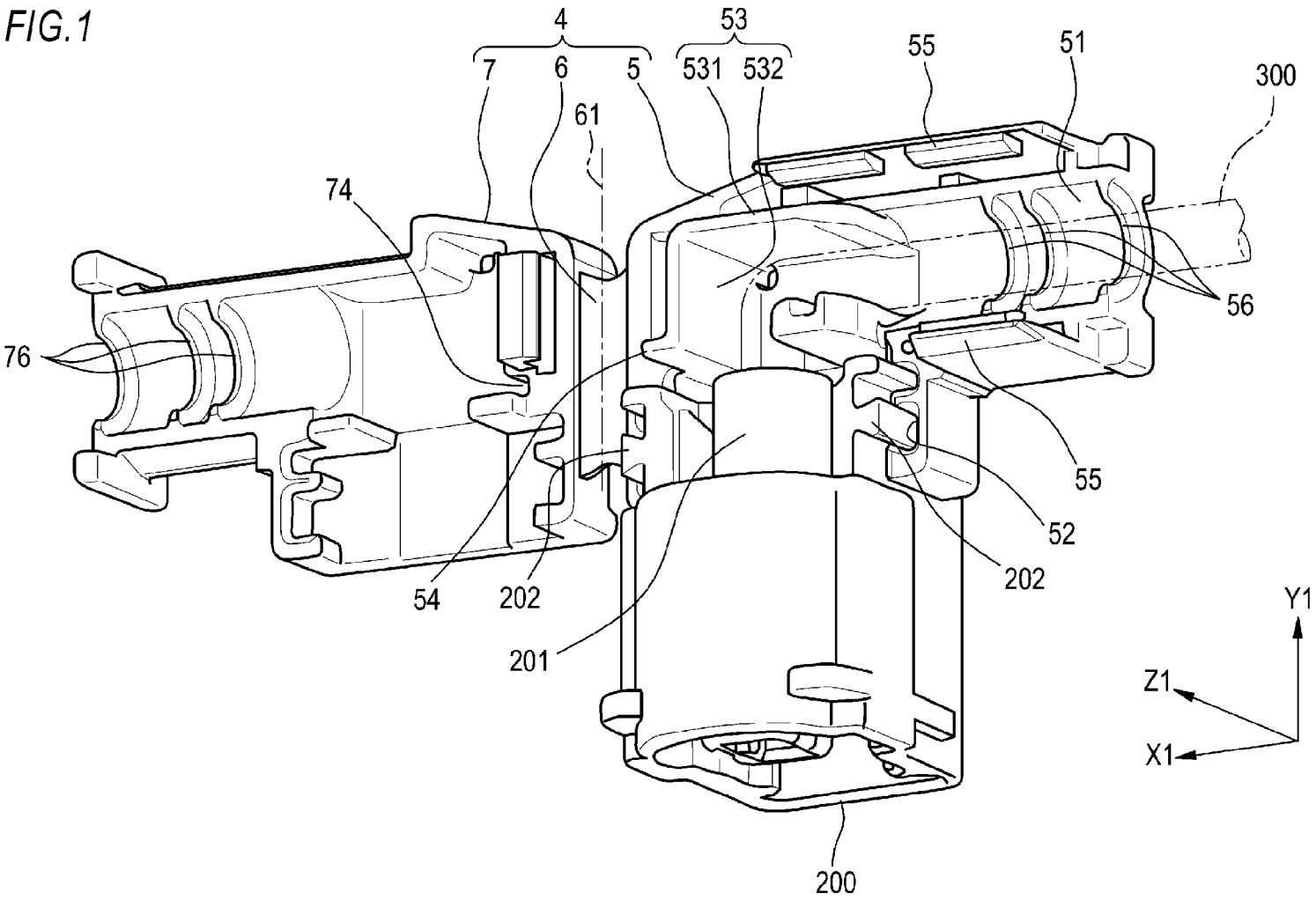
FIG. 1 is a perspective view showing a state in which a first electric wire cover in an embodiment of an electric wire cover according to the invention has been mounted at a wire lead-out end of a connector housing.
Figure 2:
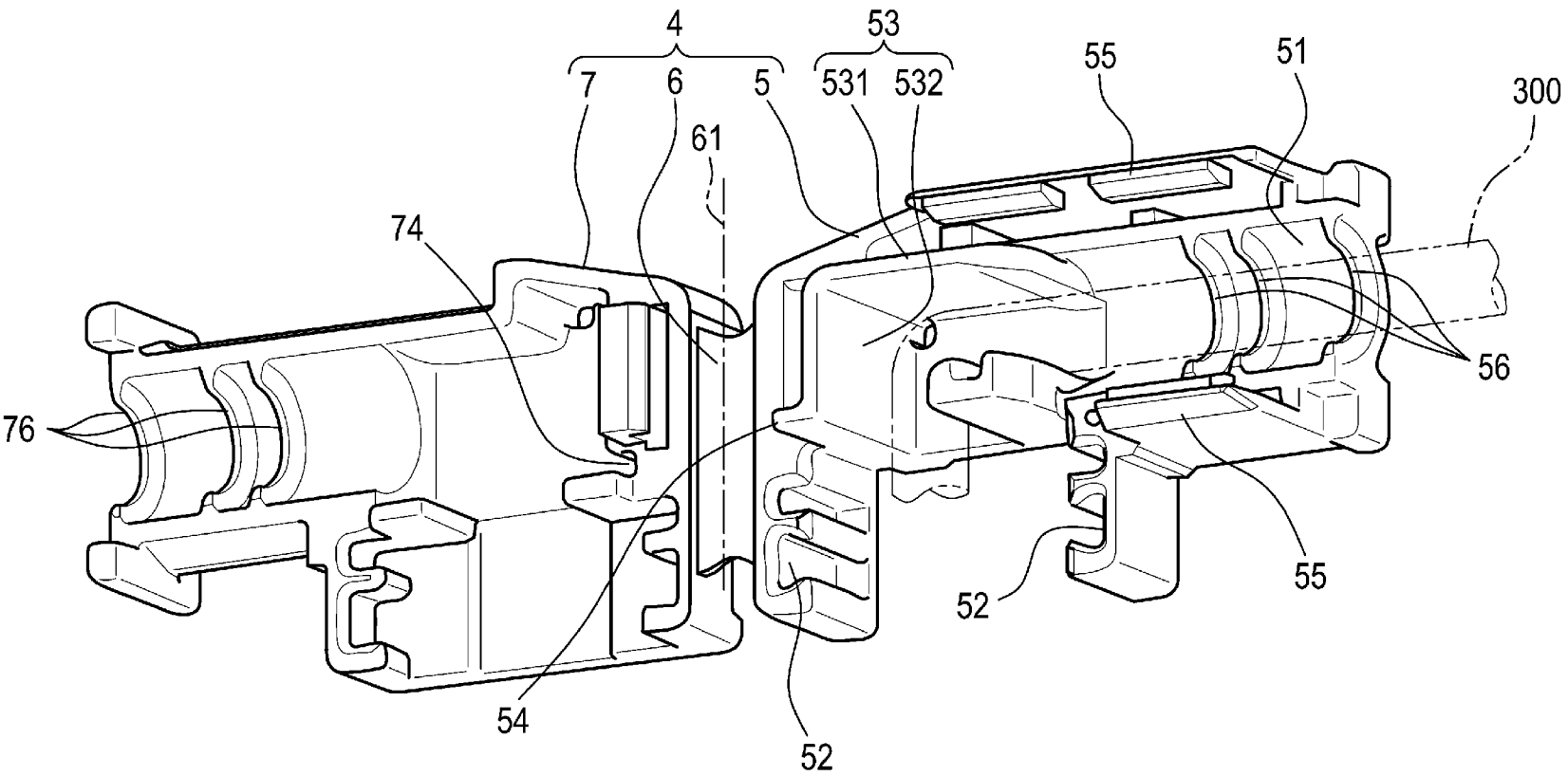
FIG. 2 is a perspective view showing a state in which the first electric wire cover and a second electric wire cover of the electric wire cover shown in FIG. 1 have been opened.

FIG. 1 to FIG. 5 show an embodiment of an electric wire cover according to the invention. FIG. 1 is a perspective view showing a state in which a first electric wire cover in the embodiment of the electric wire cover according to the invention has been mounted at a wire lead-out end of a connector housing. FIG. 2 is a perspective view showing a state in which the first electric wire cover and a second electric wire cover of the electric wire cover shown in FIG.

Figure 3:
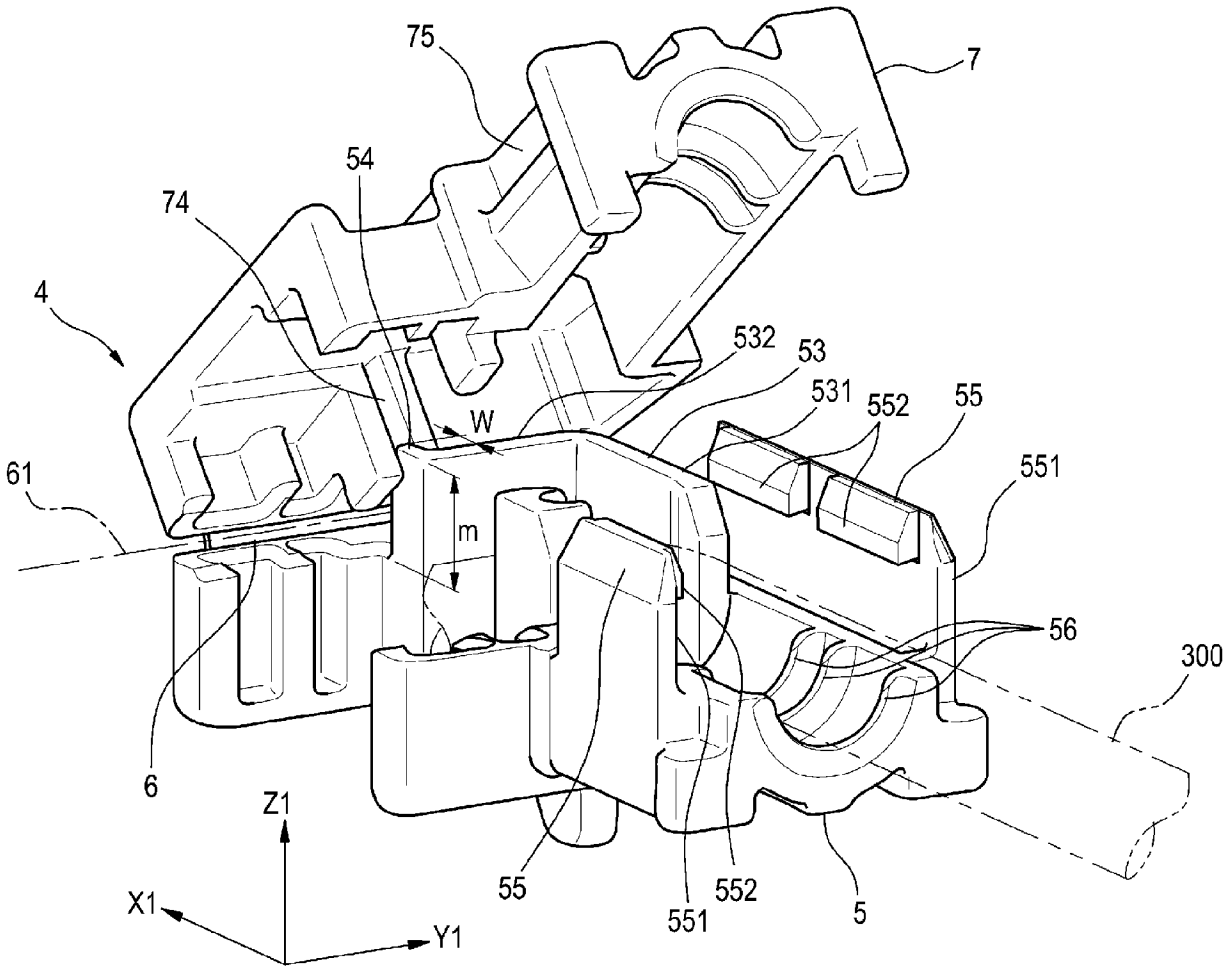
FIG. 3 is a perspective view showing a state in which operation for closing the first electric wire cover with the second electric wire cover is being performed in the electric wire cover according to the embodiment of the invention.
Figure 4:
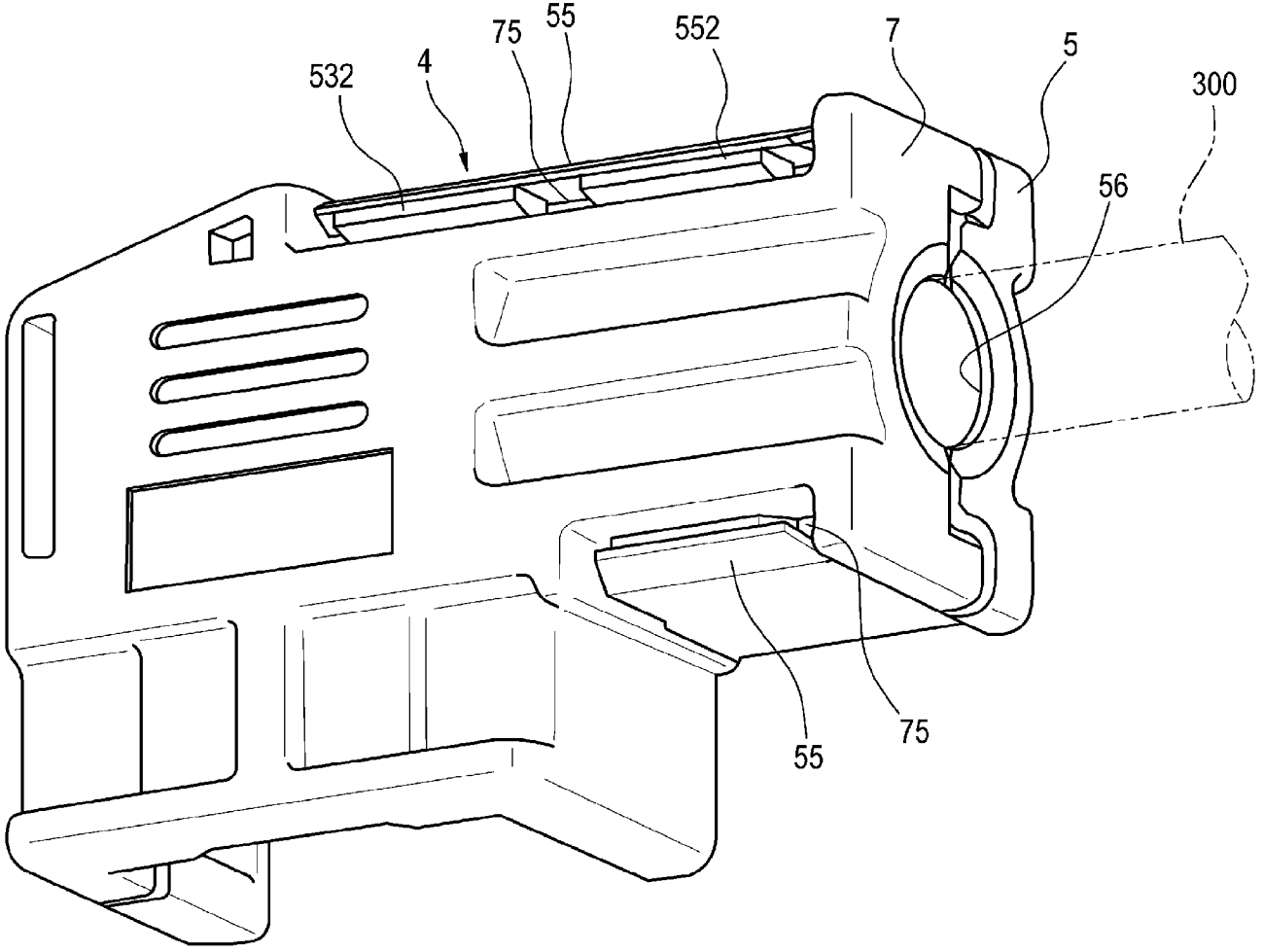
FIG. 4 is a perspective view showing a state in which the paired electric wire covers have been closed in the electric wire cover according to the embodiment of the invention.
Figure 5:
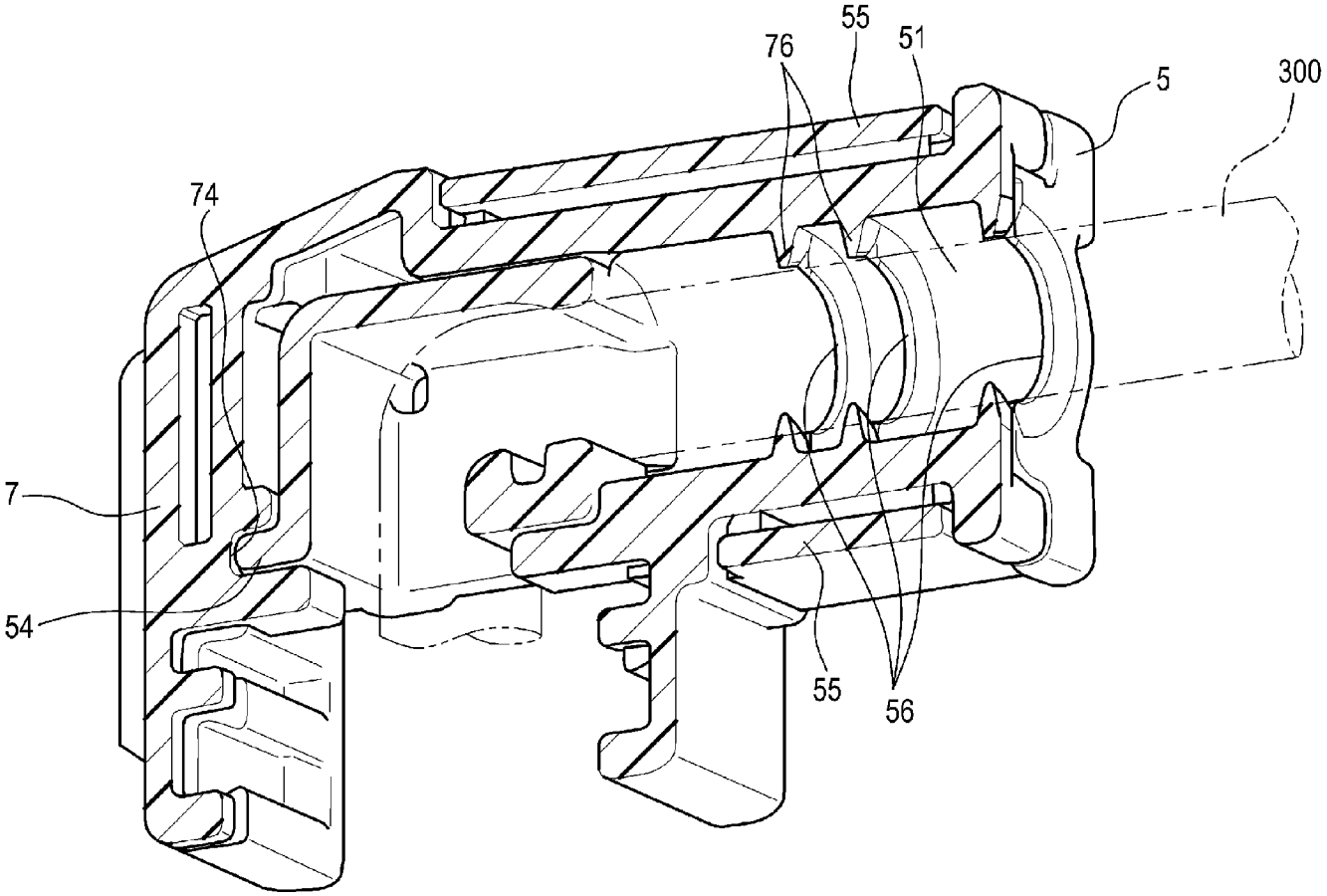
FIG. 5 is a longitudinally sectional view showing a state in which a guide groove and a rotation restriction rib are in engagement with each other when the paired electric wire covers have been closed.
Figure 6:
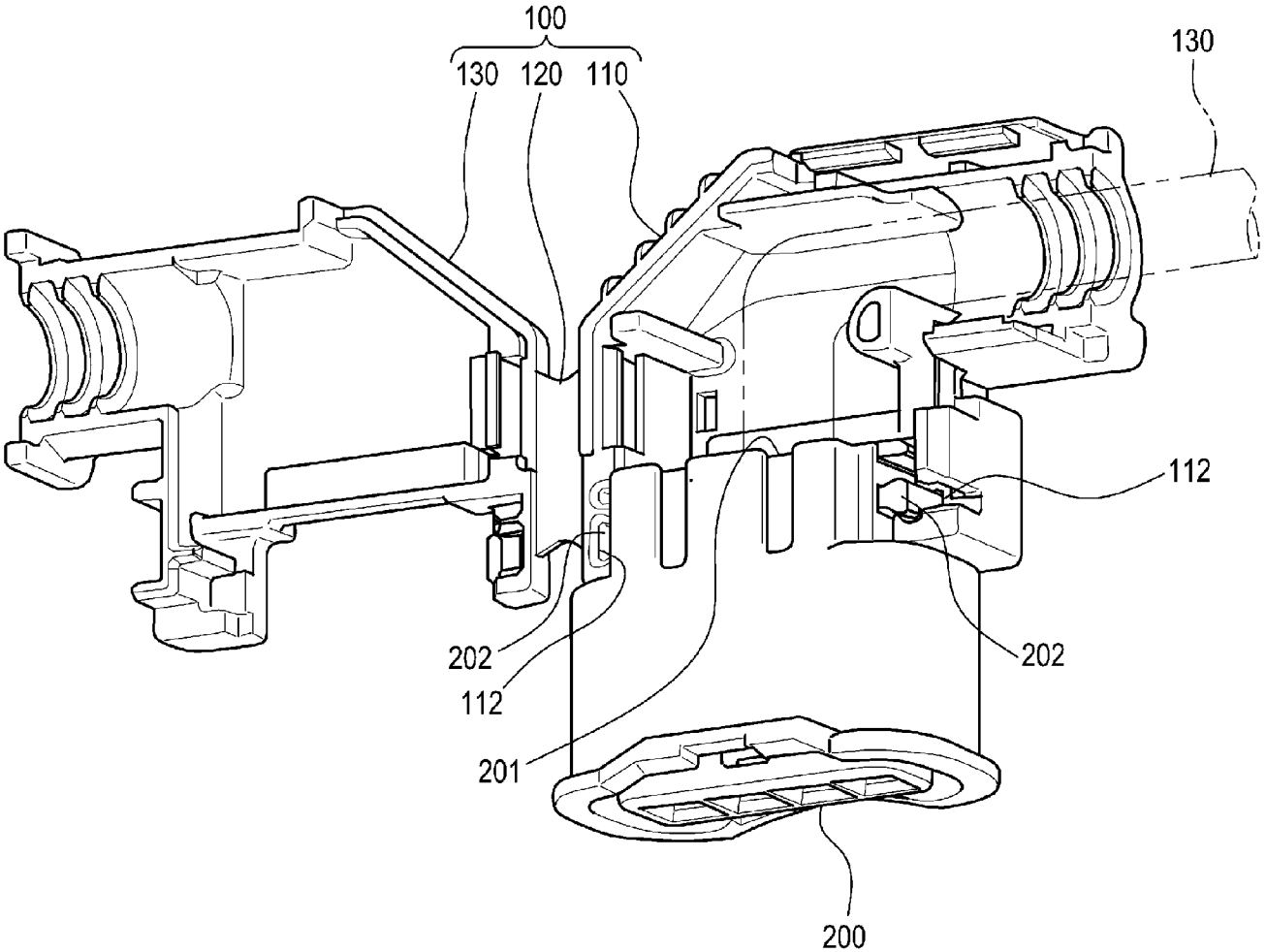
FIG. 6 is a perspective view showing a state in which a first electric wire cover of a background-art electric wire cover has been attached to a connector housing.
Figure 7:
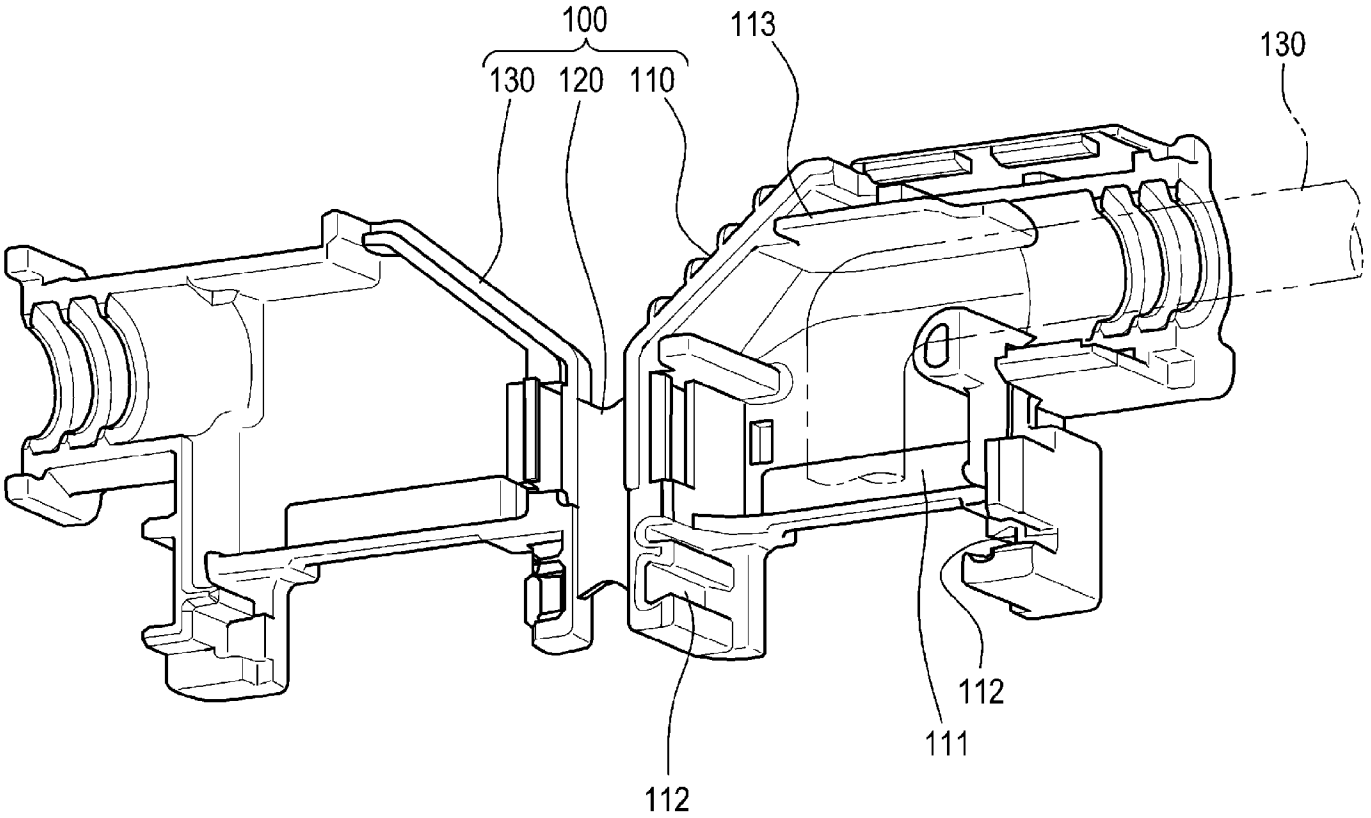
FIG. 7 is a perspective view showing a state in which a pair of electric wire covers of the background-art electric wire cover have been opened.

1 have been opened. FIG. 3 is a perspective view showing a state in which operation for closing the first electric wire cover with the second electric wire cover is being performed in the electric wire cover according to the embodiment of the invention. FIG. 4 is a perspective view showing a state in which the paired electric wire covers have been closed in the electric wire cover according to the embodiment of the invention. FIG. 5 is a longitudinally sectional view showing a state in which a guide groove and a rotation restriction rib are in engagement with each other when the paired electric wire covers have been closed.

An electric wire cover 4 according to the embodiment is made of resin. As shown in FIG. 1, the electric wire cover 4 is attached to a wire lead-out end 201 of a connector housing 200 so as to restrict the lead-out direction of an electric wire 300 led out from the wire lead-out end 201.

The electric wire cover 4 has a first electric wire cover 5 attached to the wire lead-out end 201 of the connector housing 200, and a second electric wire cover 7 formed integrally with one side edge of the first electric wire cover 5 through a hinge portion 6.

The first electric wire cover 5 has a wire arrangement space 51, a housing engagement portion 52, a wire restriction wall 53, a rotation restriction rib 54, cover connection pieces 55 and reinforcing ribs 56. The wire arrangement space 51 has a groove-like shape opened on its one side (top side). The housing engagement portion 52 is engaged with a cover engagement portion 202 provided on the external surface of the connector housing 200, so as to achieve connection with the connector housing 200. The wire restriction wall 53 is provided erectly inside the wire arrangement space 51.

The wire arrangement space 51 is a space having an L-shape in planar view and extending in the arrangement direction of the electric wire 300 to be arranged therein. The cross sectional shape of the wire arrangement space 51 is formed into a semicircular shape, a U-shape or the like, so that the electric wire 300 can be slotted into the wire arrangement space 51 from its open side.

According to the embodiment, the housing engagement portion 52 is a groove like a dovetail groove extending in the height direction of the wire lead-out end 201 (the direction of the arrow Z1 in FIG. 1). The housing engagement portion 52 is fitted to the dovetail-like cover engagement portion 202 provided in the wire lead-out end 201 to extend in the height direction of the wire lead-out end 201. Thus, the housing engagement portion 52 is restricted from moving in two direction (the direction of the arrow X1 and the direction of the arrow Y1 in FIG. 1) perpendicular to the height direction so that the first electric wire cover 5 can be connected to the wire lead-out end 201.

In FIG. 1, the direction of the arrow X1 is the width direction of the connector housing 200, and the direction of the arrow Y1 is the length width of the connector housing 200. The three arrows X1, Y1 and Z1 shown in FIG. 1 are perpendicular to one another.

The wire restriction wall 53 is provided in a corner portion of the wire arrangement space 51 on the hinge 6 side. The wire restriction wall 53 according to the embodiment has a first restriction wall 531 and a second restriction wall 532. The first restriction wall 531 extends in the width direction of the connector housing 200 perpendicular to a rotation axis 61 of the hinge portion 6. The second restriction wall 532 starts at an end portion of the first restriction wall 531 on the hinge portion 6 side and extends in the length direction of the connector housing 200 along the rotation axis 61 of the hinge portion 6. Accordingly, the second restriction wall 532 is provided in a position close to the hinge portion 6.

The first restriction wall 531 and the second restriction wall 532 are perpendicular to each other to form an L-shaped wire restriction wall as a whole in planar view.

The second restriction wall 532 abuts against a side surface of the electric wire 300 led out from the wire lead-out end 201, so that the electric wire 300 can be positioned in a shape along the length direction of the connector housing 200.

On the other hand, the first restriction wall 531 abuts against a side surface of the electric wire 300 bent at a right angle at an end edge of the second restriction wall 532, so that the electric wire 300 can be positioned in the length direction of the connector housing 200. Thus, the electric wire 300 can be led out in the width direction of the connector housing 200.

The rotation restriction rib 54 is formed integrally with the second restriction wall 532 and formed into a shape protruding on the hinge portion 6 side from the connector housing 200 side end portion of the second restriction wall 532 disposed closely to the hinge portion 6. To say other words, the rotation restriction rib 54 is provided to be located closely to the hinge portion 6 and to extend in a direction perpendicular to the rotation axis 61 of the hinge portion 6 and extend in the direction in which the paired electric wire covers abut against each other (the height direction of the connector housing 200, which is the direction of the arrow Z1 in FIG. 1).

The rotation restriction rib 54 according to the embodiment is a rib with a length w in the direction of the axis X1 and with a length m in the direction of the axis Z1, as shown in FIG. 3. The rotation restriction rib 54 is perpendicular to the second restriction wall 532.

As shown in FIG. 3 and FIG. 5, the rotation restriction rib 54 according to the embodiment slides in a guide groove 74 on the second electric wire cover 7, which will be described later, when the paired electric wire covers are operated to rotate by the hinge portion 6. Thus, rocking of the paired electric wire covers relative to each other can be restricted.

As shown in FIG. 3, the cover connection pieces 55 are provided on the opposite sides of the wire arrangement space 51 in the first electric wire cover 5. The cover connection pieces 55 include elastic pieces 551 and lock protrusions 552. The elastic pieces 551 are provided erectly on the opposite sides of the wire arrangement space 51. The lock protrusions 552 are provided to protrude inside the distal ends of the elastic pieces 551.

When the first electric wire cover 5 and the second electric wire cover 7 are brought into abutment against each other in accordance with rotation by the hinge portion 6, the lock protrusions 552 are engaged with connection step portions 75 located on the second electric wire cover 7 and correspondingly to the cover connection pieces 55. Thus, the first electric wire cover 5 and the second electric wire cover 7 are connected to each other by the cover connection pieces 55.

The reinforcing ribs 56 are provided on the inner circumferential surface of the wire arrangement space 51 so as to protrude and extend circumferentially. Thus, the rigidity of the circumferential wall of the wire arrangement space 51 is enhanced.

The hinge portion 6 is shaped into a thin plate with flexibility. The hinge portion 6 is provided on one side of the first electric wire cover 5 so as to connect the second electric wire cover 7 to the first electric wire cover 5 rotatably.

The rotation axis 61 of the hinge portion 6 extends in the longitudinal direction of the connector housing 200 (the direction of the arrow Y1 in FIG. 1) as shown in FIG. 1.

The second electric wire cover 7 covers the open portion of the wire arrangement space 51 of the first electric wire cover 5 openably/closably in accordance with rotation by the hinge portion 6. As shown in FIG. 2 to FIG. 4, the second electric wire cover 7 is provided with the guide groove 74, the connection step portions 75 and reinforcing ribs 76. The guide groove 74 is provided in a position close to the hinge portion 6. The connection step portions 75 are provided in positions corresponding to the cover connection pieces 55 of the first electric wire cover 5.

The guide groove 74 is provided to be located closely to the hinge portion 6 and to extend in a direction perpendicular to the axis 61 of the hinge portion 6 (the direction of the arrow X1 in FIG. 1) and extend in the direction in which the paired electric wire covers abut against each other (the height direction of the connector housing 200, which is the direction of the arrow Z1 in FIG. 1). As shown in FIG. 3 and FIG. 5, the guide groove 74 is a groove to which the rotation restriction rib 54 is fitted slidably thereon during rotating operation of the second electric wire cover 7 by the hinge portion 6.

In the electric wire cover 4 according to the embodiment, as shown in FIG. 3 and FIG. 5, the guide groove 74 and the rotation restriction rib 54 are fitted to each other so that rocking of the paired electric wire covers relative to each other can be restricted during rotating operation for closing the second electric wire cover 7.

As shown in FIG. 4, the lock protrusions 552 of the cover connection pieces 55 of the first electric wire cover 5 are engaged with the connection step portions 75 when the second electric wire cover 7 is brought into abutment against the first electric wire cover 5 in accordance with rotating operation by the hinge portion 6. Thus, the second electric wire cover 7 is fixed to the first electric wire cover 5.

The reinforcing ribs 76 are provided to protrude on the inner circumferential surface facing the wire arrangement space 51, so as to extend circumferentially, as shown in FIG. 2. Thus, the rigidity of the second electric wire cover 7 can be enhanced.

The reinforcing ribs 76 are provided in positions corresponding to the reinforcing ribs 56 of the first electric wire cover 5. When the first electric wire cover 5 and the second electric wire cover 7 are closed, the reinforcing ribs 76 cooperate with the reinforcing ribs 56 so as to form annular structures enclosing the outer circumference of the electric wire 300, as shown in FIG. 5. Incidentally, the reinforcing ribs 56 and the reinforcing ribs 76 serve for engagement with grooves of a not-shown corrugated tube covering the electric wire 300.

In the electric wire cover 4 according to the embodiment described above, when the paired electric wire covers of the electric wire cover 4 are closed in accordance with rotation by the hinge portion 6, the rotation restriction rib 54 provided in one electric wire cover 5 of the paired electric wire covers slides in the guide groove 74 provided in the other electric wire cover 7. Thus, rocking of the paired electric wire covers relative to each other can be restricted.

That is, when the paired electric wire covers are closed, misalignment between the paired electric wire covers caused by twisting of the hinge portion 6 is prevented by engagement between the guide groove 74 and the rotation restriction rib 54, so that the paired electric wire covers can be closed smoothly.

Accordingly, operation for closing the paired electric wire covers is so easy that the assemblability of the electric wire cover 4 can be improved.

In addition, in the electric wire cover 4 according to the embodiment, the guide groove 74 and the rotation restriction rib 54 are close to the hinge portion 6 so that the guide groove 74 and the rotation restriction rib 54 can be miniaturized. It is therefore possible to miniaturize the electric wire cover 4.

In addition, since the guide groove 74 and the rotation restriction rib 54 are close to the hinge portion 6, engagement between the guide groove 74 and the rotation restriction rib 54 is started at an early stage of rotating operation for closing the paired electric wire covers.

That is, the effect of preventing misalignment by the engagement between the guide groove 74 and the rotation restriction rib 54 can be obtained from the early stage of the rotating operation. It is therefore possible to improve smoothness in the closing operation.

In addition, in the electric wire cover 4 according to the embodiment, the rotation restriction rib 54 is formed integrally with the wire restriction wall 53 and formed into a wall-like shape perpendicular to the wire restriction wall 53 so as to reinforce strength of each other. Accordingly, high strength can be secured in both the rotation restriction rib 54 and the wire restriction wall 53 without increasing their thickness.

In addition, in the electric wire cover 4 according to the embodiment, the wire restriction wall 53 is integrally formed into an L-shape so that the electric wire 300 can be positioned in an L-shape. Accordingly, high strength can be secured in the wire restriction wall 53 without increasing the thickness of the wire restriction wall 53, and the electric wire 300 can be positioned more accurately in a fixed position. In addition, the L-shaped wire restriction wall 53 also serves as a reinforcing rib for suppressing deformation of the first electric wire cover 5. It is therefore possible to improve the rigidity of the first electric wire cover 5 itself without additionally providing a special reinforcing rib.

Incidentally, the invention is not limited to the aforementioned embodiment, but suitable deformations, improvements and so on may be made thereon. In addition, materials, shapes, dimensions, numbers, arrangement places, etc. of constituent elements in the aforementioned embodiment are not limited but may be selected desirably if the invention can be attained.

For example, although the rotation restriction rib 54 and the guide groove 74 are provided in the first electric wire cover 5 and the second electric wire cover 7 respectively in the aforementioned embodiment, the rotation restriction rib 54 and the guide groove 74 are conversely provided in the second electric wire cover 7 and the second electric wire cover 5 respectively.

According to an aspect of the invention, there is provided An electric wire cover (4) including: a first electric wire cover (5) which includes a wire arrangement space (51) like a groove opened on one side, and which is adapted to be attached to a wire lead-out end (201) of a connector housing (200); and a second electric wire cover (7) which is formed integrally with the first electric wire cover (5) through a hinge portion (6), and which is configured to cover an open portion of the wire arrangement space (51) openably/closably, wherein a guide groove (74) is provided in one of the first electric wire cover (5) and the second electric wire cover (7), and extends in a direction perpendicular to a rotation axis (61) of the hinge portion (6), and a rotation restriction rib (54) is provided in the other of the first electric wire cover (5) and the second electric wire cover (7), and extends in the direction perpendicular to the rotation axis (61) of the hinge portion (6), and the rotation restriction rib (54) is configured to slide in the guide groove (74) during rotating operation by the hinge portion (6) so as to restrict rocking of the first electric wire cover (5) and the second electric wire cover (7) relative to each other.

According to the aforementioned configuration, when the paired electric wire covers are closed in accordance with rotation by the hinge portion, the rotation restriction rib provided in one of the electric wire covers slides in the guide groove provided in the other electric wire cover. Thus, rocking of the paired electric wire covers relative to each other can be restricted.

That is, when the paired electric wire covers are closed, misalignment between the paired electric wire covers caused by twisting of the hinge portion is prevented by engagement between the guide groove and the rotation restriction rib, so that the paired electric wire covers can be closed smoothly.

Accordingly, operation for closing the paired electric wire covers is so easy that the assemblability of the electric wire cover can be improved.

The guide groove (74) and the rotation restriction rib (54) may be provided in positions close to the hinge portion (6).

In this case, the guide groove and the rotation restriction rib are close to the hinge portion so that the guide groove and the rotation restriction rib can be miniaturized. It is therefore possible to miniaturize the electric wire cover.

In addition, since the guide groove and the rotation restriction rib are close to the hinge portion, engagement between the guide groove and the rotation restriction rib is started at an early stage of rotating operation for closing the paired electric wire covers.

That is, the effect of preventing misalignment by the engagement between the guide groove and the rotation restriction rib can be obtained from the early stage of the rotating operation. It is therefore possible to improve smoothness in the closing operation.

The first electric wire cover (5) may include a wire restriction wall (53) which is configured to abut against a side surface of an electric wire (300) inserted into the wire arrangement space (51), so as to position the electric wire (300), and the rotation restriction rib (54) may be formed integrally with the wire restriction wall (53) and formed into a wall-like shape perpendicular to the wire restriction wall (53).

In this case, the rotation restriction rib is formed integrally with the wire restriction wall and formed into a wall-like shape perpendicular to the wire restriction wall so as to reinforce strength of each other. Accordingly, high strength can be secured in both the rotation restriction rib and the wire restriction wall without increasing their thickness.

The wire restriction wall (53) may be integrally formed into an L-shape to position the electric wire (300) in an L-shape.

In this case, the wire restriction wall is integrally formed into an L-shape to position the electric wire in an L-shape. Accordingly, high strength can be secured in the wire restriction wall without increasing the thickness of the wire restriction wall, and the electric wire can be positioned more accurately in a fixed position. In addition, the L-shaped wire restriction wall also serves as a reinforcing rib for suppressing deformation of the first electric wire cover. It is therefore possible to improve the rigidity of the first electric wire cover itself without additionally providing a special reinforcing rib.

According to an aspect of the invention, when a pair of electric wire covers are closed, misalignment between the paired electric wire covers caused by twisting of a hinge portion can be prevented so that the paired electric wire covers can be closed smoothly.

What is claimed is:

1. An electric wire cover comprising:

a first electric wire cover which includes a wire arrangement space like a groove opened on one side, and which is adapted to be attached to a wire lead-out end of a connector housing; and a second electric wire cover which is formed integrally with the first electric wire cover through a hinge portion, and which is configured to cover an open portion of the wire arrangement space openably/closably, wherein a guide groove is provided in one of the first and second electric wire covers, and extends in a direction perpendicular to a rotation axis of the hinge portion, and a rotation restriction rib is provided in the other of the first and second electric wire covers and extends in the direction perpendicular to the rotation axis of the hinge portion, and the rotation restriction rib is configured to slide in the guide groove during rotating operation by the hinge portion so as to restrict rocking of the first and second electric wire covers relative to each other.

2. The electric wire cover according to claim 1, wherein the guide groove and the rotation restriction rib are provided in positions close to the hinge portion.

3. The electric wire cover according to claim 2, wherein the first electric wire cover includes a wire restriction wall which is configured to abut against a side surface of an electric wire inserted into the wire arrangement space, so as to position the electric wire, and the rotation restriction rib is formed integrally with the wire restriction wall and formed into a wall-like shape perpendicular to the wire restriction wall.

4. The electric wire cover according to claim 3, wherein the wire restriction wall is integrally formed into an L-shape to position the electric wire in an L-shape.

* * * * *